US010426699B2

(12) United States Patent
Clouser et al.

(10) Patent No.: US 10,426,699 B2
(45) **Date of Patent: *Oct. 1, 2019**

(54) DEVICE AND METHOD FOR DOCKING A VIAL WITH A CONTAINER

(71) Applicant: Gary L. Sharpe, Naples, FL (US)

(72) Inventors: Doug Clouser, Galloway, OH (US); Gary L. Sharpe, Naples, FL (US)

(73) Assignee: Gary L. Sharp, Naples, FL (US)

( * ) Notice: Subject to any disclaimer, the term of this patent is extended or adjusted under 35 U.S.C. 154(b) by 608 days.

This patent is subject to a terminal disclaimer.

(21) Appl. No.: 14/954,212

(22) Filed: Nov. 30, 2015

(65) Prior Publication Data

US 2017/0151128 A1 Jun. 1, 2017

(51) Int. Cl.
*A61J 1/20* (2006.01)
*A61J 1/10* (2006.01)

(52) U.S. Cl.
CPC ..... *A61J 1/2003* (2015.05); *A61J 1/10* (2013.01); *A61J 1/2089* (2013.01)

(58) Field of Classification Search
CPC ..... A61J 1/2003; A61J 1/10; A61J 1/2089; B65B 7/16; A61M 1/342
USPC ..... 53/287, 489, 328, 305, 476, 285; 604/905, 414
See application file for complete search history.

(56) References Cited

U.S. PATENT DOCUMENTS 807,080 A 12/1905 Keenan
1,657,782 A 1/1928 Berg
1,801,381 A 4/1931 Walmsley
1,981,565 A 11/1934 Namur
1,990,301 A 2/1935 Pietro
2,080,393 A 5/1937 Moore
2,088,010 A 7/1937 Petersen
2,366,524 A 1/1945 Harder
2,647,674 A 8/1953 Bausano
2,878,632 A 3/1959 Foresman, Jr.
3,169,665 A 2/1965 Colley
3,245,586 A 4/1966 Haggitt
3,494,506 A 2/1970 Fujimoto
3,715,865 A 2/1973 Davis
3,744,665 A * 7/1973 Spoto ..... B01L 9/06 211/76
3,803,800 A 4/1974 Tavernier
4,068,449 A 1/1978 Harper
4,599,123 A 7/1986 Christensson
5,037,390 A 8/1991 Raines et al.
5,185,985 A 2/1993 Vetter et al.
5,934,511 A 8/1999 Ausmus
(Continued)

*Primary Examiner* — Andrew M Tecco
*Assistant Examiner* — Nicholas E Igbokwe
(74) *Attorney, Agent, or Firm* — Standley Law Group LLP; Jeffrey Standley; Beverly Marsh

(57) ABSTRACT

A device and method for docking a vial with a container adapter is disclosed. An adapter may be used to establish fluid communication between the vial and a container. The adapter may be positioned within an aperture in a platform of the device. A notch may be placed adjacent to the first aperture so that the vial and adapter may be removed horizontally from the device. A cavity may be positioned below the first aperture to accept at least a portion of a container which may be in fluid communication with the adapter. The platform may be removable, contain multiple apertures, or may be configured to receive various adapter types.

13 Claims, 12 Drawing Sheets

(56) References Cited

U.S. PATENT DOCUMENTS 6,070,761 A 6/2000 Bloom et al.
6,527,758 B2 * 3/2003 Ko ..... A61J 3/002 604/403
6,571,534 B2 6/2003 De Young et al.
6,604,903 B2 8/2003 Osborne et al.
6,689,108 B2 2/2004 Lavi et al.
6,723,068 B2 4/2004 Lavi et al.
6,877,530 B2 4/2005 Osborne et al.
7,128,105 B2 10/2006 Tribble et al.
7,299,601 B2 11/2007 Yoshida et al.
7,520,108 B2 4/2009 Kristiansson et al.
7,856,860 B1 * 12/2010 Collison ..... B21D 51/48 412/8
7,900,658 B2 3/2011 Osborne et al.
7,985,216 B2 7/2011 Daily et al.
8,382,696 B2 2/2013 Beiriger
8,425,487 B2 4/2013 Beiriger et al.
8,535,289 B1 * 9/2013 Forbes ..... A61J 1/2096 604/408
8,562,584 B2 10/2013 Beiriger et al.
9,168,202 B2 * 10/2015 Clouser ..... A61J 1/20
2003/0036725 A1 * 2/2003 Lavi ..... A61M 5/2066 604/91
2008/0109957 A1 * 5/2008 Blancke ..... B62B 3/10 4/661
2010/0084041 A1 4/2010 Fehr et al.
2011/0004144 A1 1/2011 Beiriger et al.
2011/0004145 A1 * 1/2011 Beiriger ..... A61M 1/342 604/6.11
2011/0030316 A1 * 2/2011 Blumenstock ..... B65B 7/2821 53/319
2011/0030320 A1 2/2011 Blumenstock et al.
2012/0186201 A1 * 7/2012 Clouser ..... A61J 1/20 53/476
2012/0187229 A1 * 7/2012 Clouser ..... A61J 7/0007 241/30
2013/0035658 A1 2/2013 Haenggi et al.
2013/0296807 A1 11/2013 Lintern et al.

* cited by examiner

DEVICE AND METHOD FOR DOCKING A VIAL WITH A CONTAINER

CROSS-REFERENCE TO RELATED APPLICATIONS

None.

TECHNICAL FIELD

Embodiments generally relate to mechanical systems, and more specifically to a device and method for docking a vial with a container.

BACKGROUND OF THE ART

Many medical fluids are typically manufactured and shipped in vials, which may have tamper-resistant, measurement, durability or security features. Prior to using the fluid in a medical procedure, the fluid may need to be transferred to a different container. Thus, in various medical applications it may be desirable to create fluid communication between a vial and some type of alternate container (sometimes fluid bags such as intravenous bags), often referred to as "docking." The containers may be any one of various types in a given application, and more than one type of container may be utilized in a given setting. Containers may also exhibit a range of adapters, caps or other such means of controlling ingress and egress of fluid to the container. Cap configurations generally known in the art include, for instance, components of Mini-Bag Plus fluid IV containers or Vial-Mate Adaptor devices, the latter of which acts as an adapter by providing fluid connection between a vial and other container.

SUMMARY OF THE EXEMPLARY EMBODIMENTS

An exemplary embodiment herein provides a device which can dock a vial with another container or adapter quickly, easily, at a low cost and with a low spatial footprint. The device preferably contains a cavity and optional notch which can accept at least a portion of the chosen container or adaptor for alignment with the vial. A platform may be used to hold or secure the vial over top a cap or adapter, which may contain a piercing aperture for establishing fluid communication between the vial and the container. An exemplary platform may contain an aperture for holding the cap in place during the docking process as well as a notch for allowing the cap and at least a portion of the container to exit the device once the docking process has been completed.

In a preferred embodiment, a lever arm may be moved in a downward motion to cause a plunger to move in a corresponding downward motion. The plunger preferably contains a tapered collar which can accept and center vials of various diameters prior to pressing the vial into the cap. The cap may also have a tapered portion for accepting and centering the vial. An exemplary cap may also have a ledge which holds the cap securely in place atop the platform while the vial is being pressed down into the cap for docking.

In some embodiments, the platform is removable, and may be provided with a first aperture having a guide channel extending from the top of the platform to the bottom. Some embodiments may include a second aperture arranged opposite the first aperture, and may be provided with a different diameter than the first aperture. The first and second aperture may each have an opening along one of two opposing sides of the platform.

In one embodiment, the first aperture includes at least two concentric apertures having a common center-line, different diameters, and different depths. In further embodiments, the first aperture has an opening along one side of the platform. Some embodiments may be configured such that the first aperture includes an upper portion and a lower portion arranged to create a ledge adapted to receive the adapter seated thereon. Further embodiments may be configured such that the upper portion is sized larger in the horizontal dimension than the lower portion, and the lower portion includes a pair of parallel sides joined by a curved back wall.

An embodiment of the invented device includes a base, a vertical support extending upwardly from the base, a removable platform positioned above the base and substantially parallel to the base, a first aperture in the platform sized to accept the adapter but not allowing the adapter to pass completely through, a notch along one side of the platform terminating at the first aperture, a head support extending horizontally from the vertical support, a lever arm hingedly fastened to the vertical support, and a plunger adapted to slide within the head support and attached to the level arm such that rotation of the lever arm causes the plunger to travel vertically to press the vial down to dock with the adapter secured within the first aperture.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
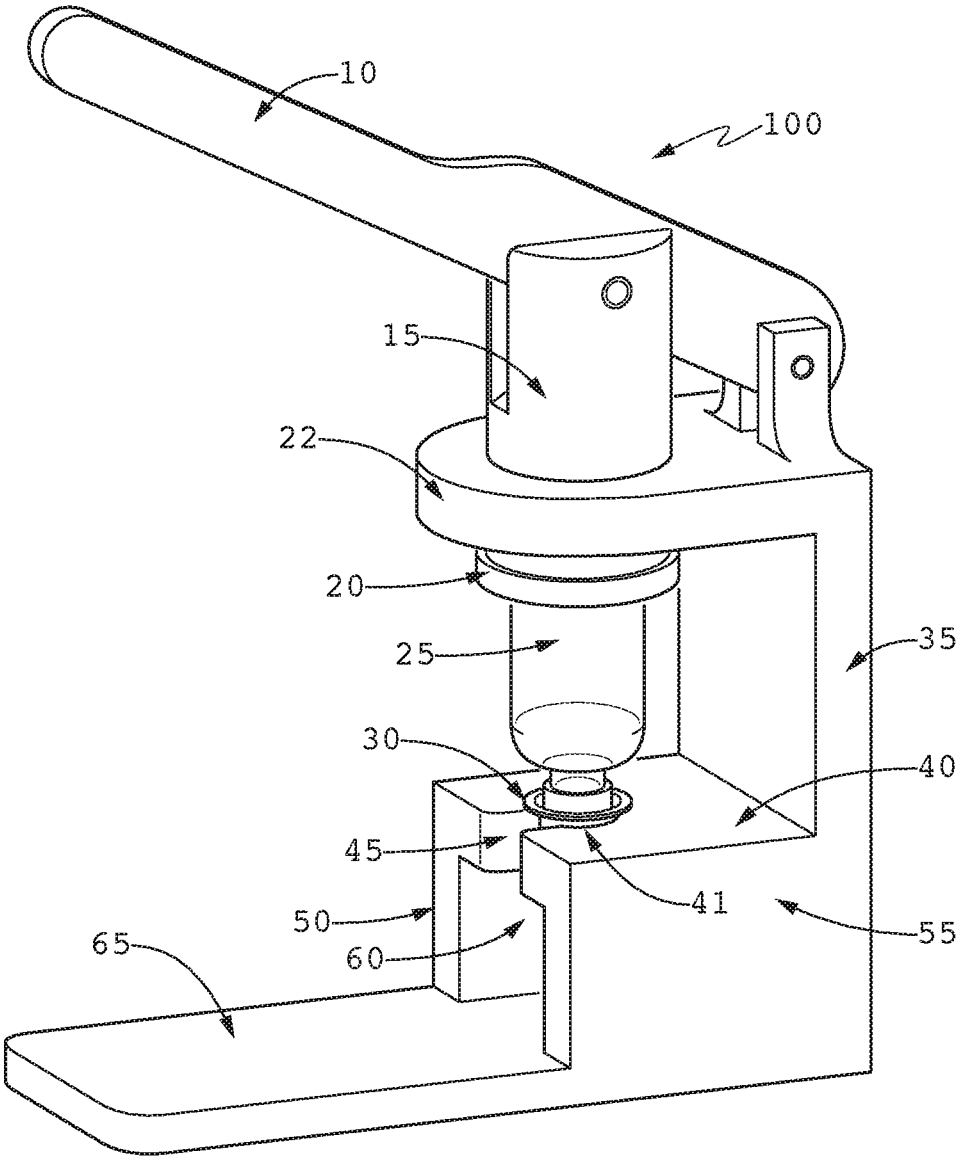
FIG. 1 is a perspective view of an exemplary embodiment of the device.

FIG. 1 is a perspective view of an exemplary embodiment of the device 100. A base 65 and vertical support 35 may provide a frame for the device 100. A platform 40 is preferably arranged above the base 65 and rests upon a first base member 50 and second base member 55. The space defined by the area between the base 65, platform 40, vertical support 35, first base member 50, and second base member 55 may define a cavity 60, which can accept at least a portion of the chosen container or adapter to be docked with a vial 25 or other such container. Preferably, the portion of the platform 40 which is opposite the vertical support 35 contains a cutout or notch 45 to allow at least a portion of the chosen container to pass through prior to and after the docking process. In some embodiments, an adapter or cap 30 may be used to dock the vial 25 with the chosen container (not shown in FIG. 1). If an adapter 30 is used, the platform 40 would preferably contain an aperture 41 for accepting the adapter 30. A lever arm 10 may be hingedly connected to the vertical support 35. The lever arm 10 may also be connected to a plunger 15 such that a downward motion of the lever arm 10 causes the plunger 15 to move downward as well. In the opposite direction, an upward motion on the lever arm 10 preferably causes an upward motion by the plunger 15. Those skilled in the art will appreciate that other mechanical connections may be used in which, for example, an upward motion of the lever arm would cause downward motion by the plunger, without departing from the scope of the invention. It is sufficient that a mechanical input is provided that, when actuated, will result in the movement of the plunger. The bottom portion of the plunger 15 preferably contains a collar 20 which accepts the vial 25. A head support 22 may be connected to the vertical support 35 and may be used to guide the plunger 15 in the desired direction as it travels through its upward and downward motions.

The device 100 can be constructed out of any number of materials, including but not limited to metals, plastics, composites, wood, or any combination of these. A preferred embodiment would be comprised primarily of plastics and an exemplary embodiment would be comprised primarily of high-density polyethylene (HDPE).

Figure 2:
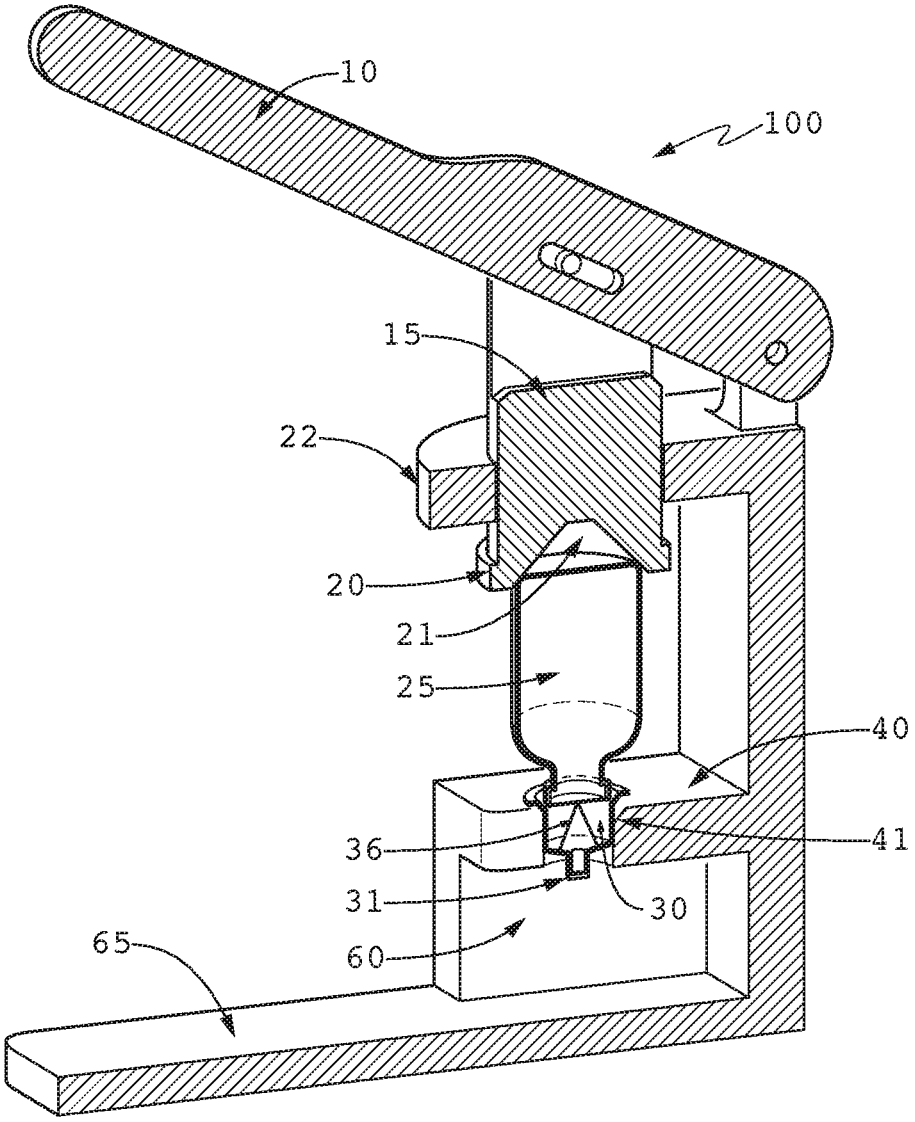
FIG. 2 is a perspective sectional view thereof.

FIG. 2 is a perspective sectional view of the device 100 taken at the plane of symmetry traversing the device 100 from front to back. The collar 20 preferably contains a recess 21, shown in this embodiment with a generally conical shape, for accepting and centering the vial 25 within the plunger 15. The aperture 41 within the platform 40 may accept the adapter 30. Preferably, the aperture 41 is vertically aligned with the conical recess 21 in the collar 20 so that a downward motion of the lever arm 10 presses the vial 25 onto the adapter 30. In some embodiments, the adapter 30 may contain a piercing aperture 36 which may pierce a portion of the vial 25 when pressed into the adapter 30. In this manner, the vial 25 may remain completely sealed until pierced by this portion 36 of the adapter 30. An exemplary adapter 30 may also contain an attachment means 31 to establish fluid communication with the chosen container. In this particular embodiment, the attachment means 31 is a stem for accepting a tube or hose from the chosen container.

Figure 3A:
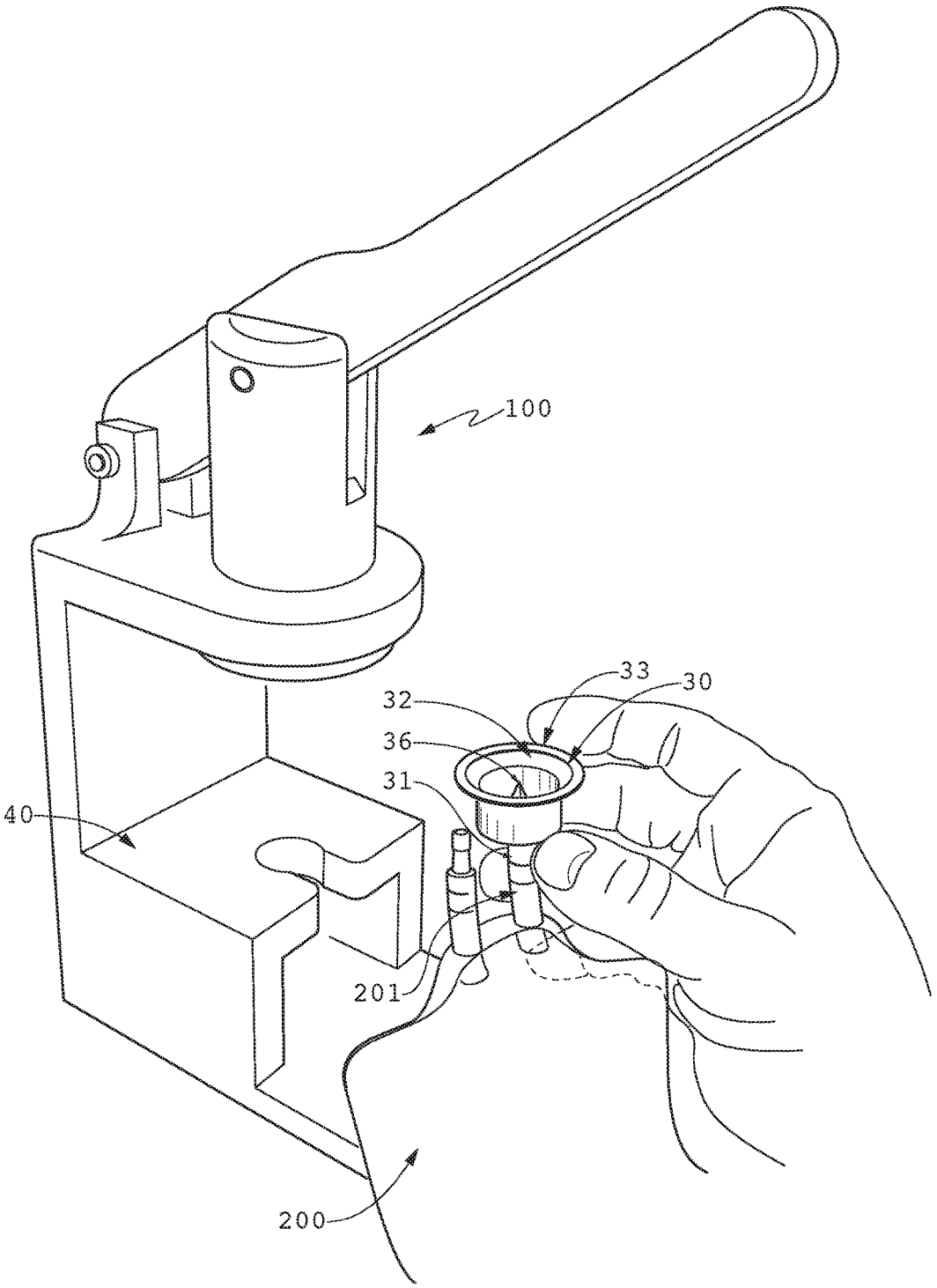
FIGS. 3A-3F are a series of illustrations showing an exemplary method for using the device of FIG. 1 for docking a vial with a container.

FIG. 3A is an illustration of an initial step in an embodiment for using the device 100 to dock a vial 25 with a container 200. In this embodiment, the container 200 is a fluid bag, commonly known in the art as a 'mini-bag.' Of course, the device 100 can be used with any number of container styles, shapes, and sizes. Here, the container 200 contains a tube 201 which is adapted to attach to the attachment means 31 of the adapter or cap 30. In this particular embodiment, the tube 201 is sized to slide overtop a stem which is used as the attachment means 31. In this embodiment, the cap 30 contains a ledge 33, wherein the aperture 41 of the platform 40 is sized and adapted so that the ledge 33 of the cap 30 rests atop the platform 40. Also shown in this figure is the piercing aperture 36 within the cap 30. In this embodiment, the cap 30 also contains a tapered portion 32 for accepting and centering the vial prior to docking.

Figure 3B:
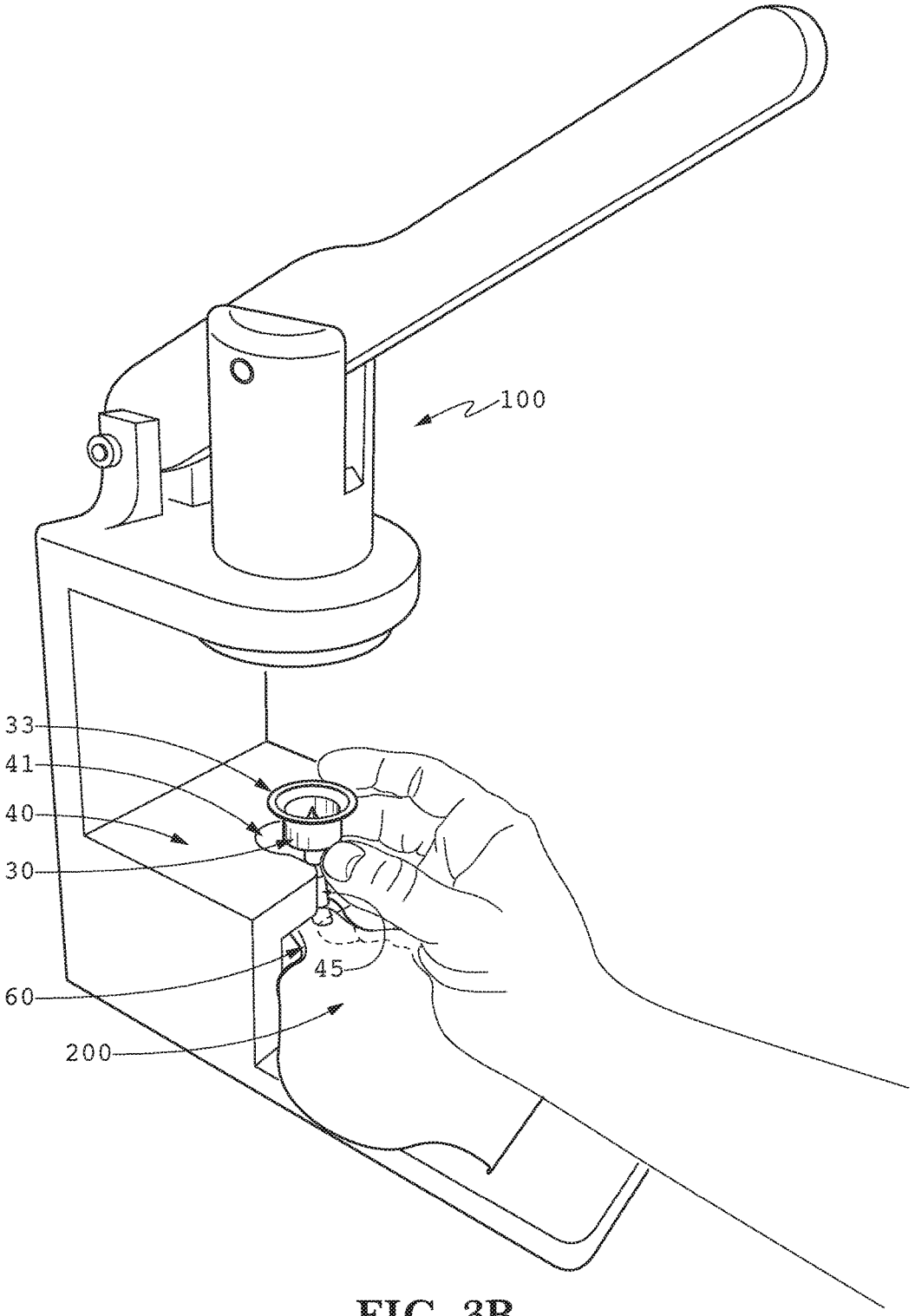

FIG. 3B is an illustration showing the container 200 and cap 30 assembly being placed within the device 100. The configuration of embodiments of the device 100 wherein a cavity 60 is provided is useful when applied to container 200 and cap 30 assemblies such as this that may require assembly prior to joining the adapter with the container. In this embodiment, a portion of the container 200 is thus permitted to pass through the notch 45 in the platform 40 so that the cap 30 can rest within the aperture 41. To prevent the cap 30 from moving vertically during the docking process, the ledge 33 of the cap 30 should preferably rest on the top surface of the platform 40. The cavity 60 may also contain at least a portion of the container 200 during this embodiment of the docking process.

Figure 3C:
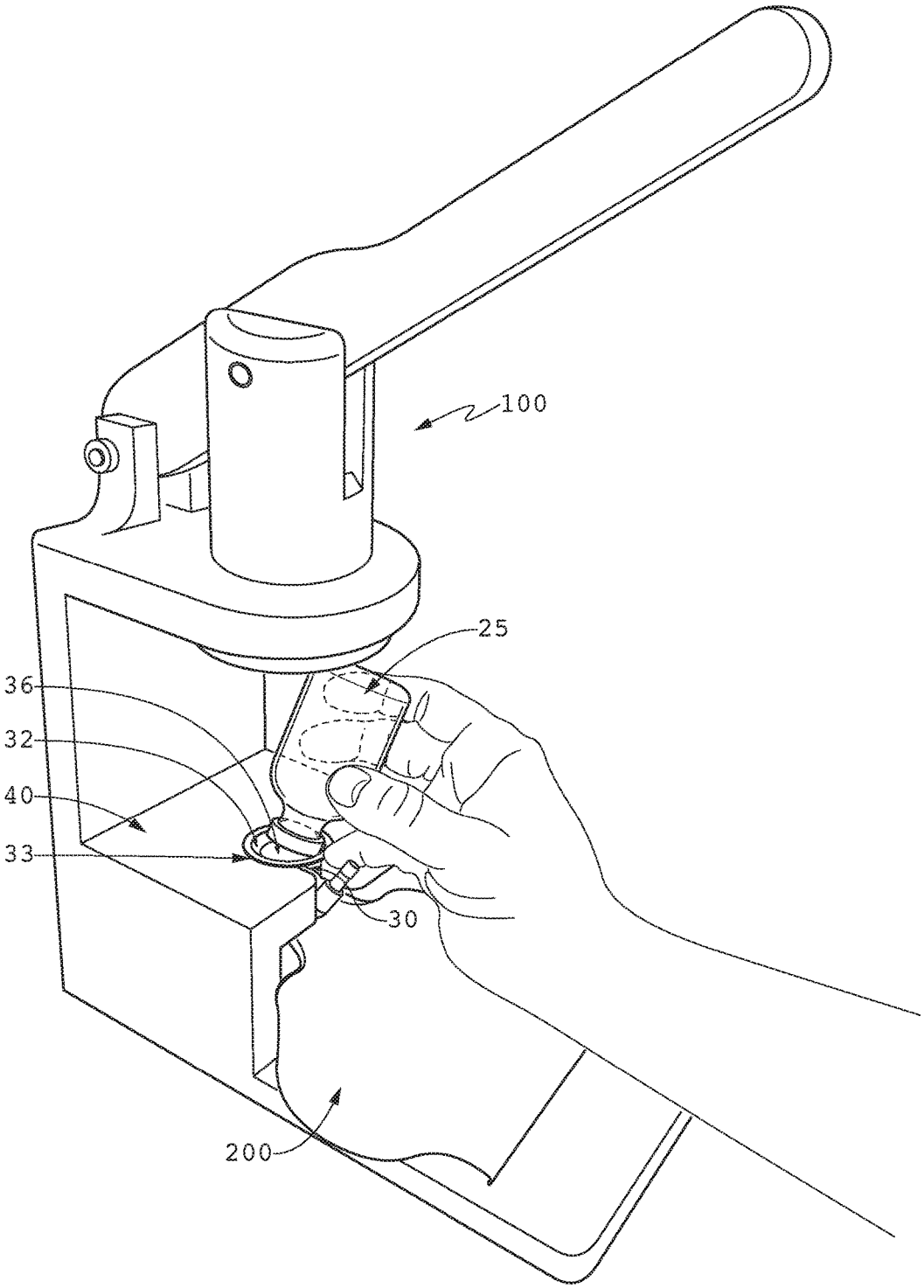
Figure 3D:
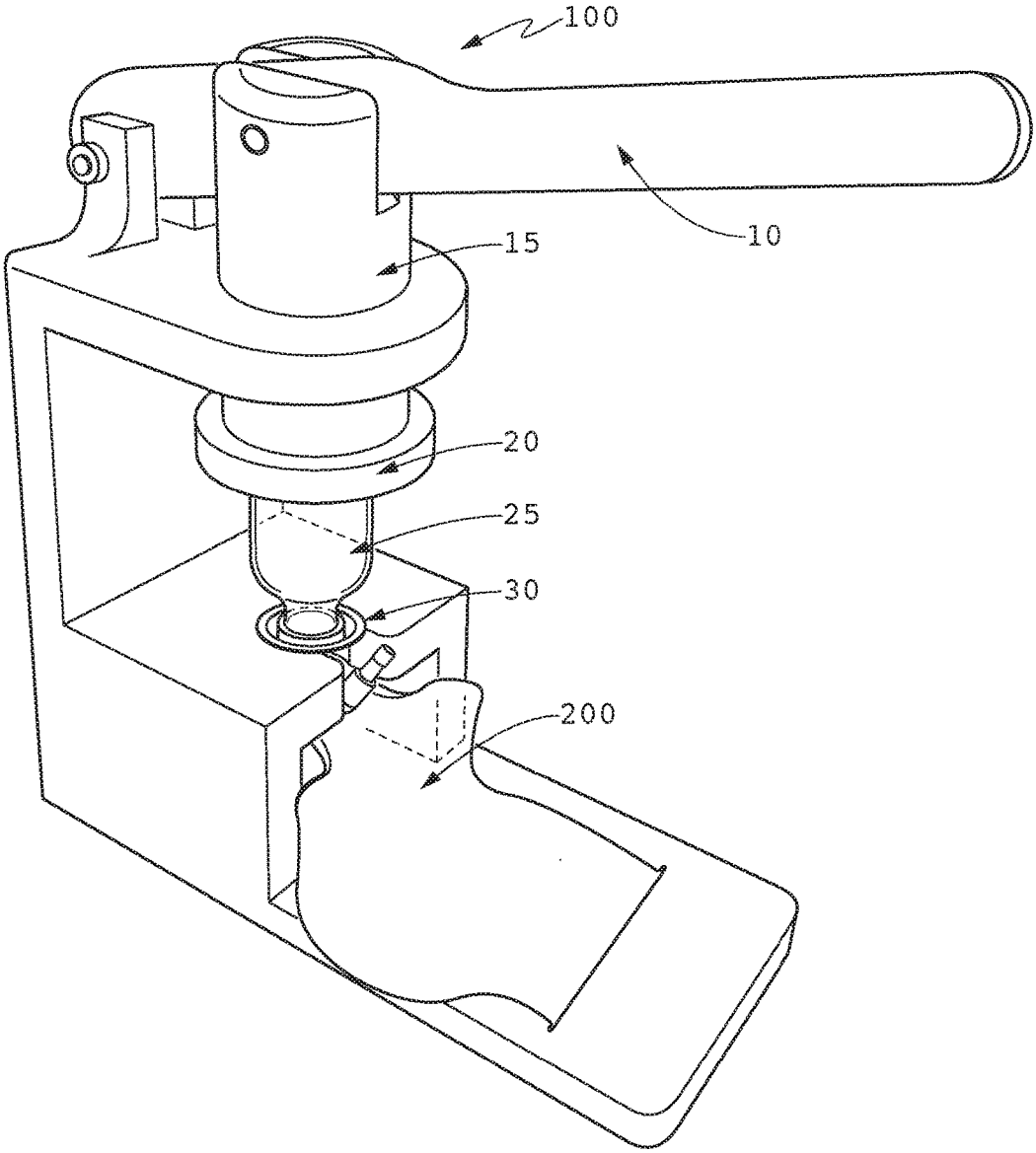
Figure 3E:
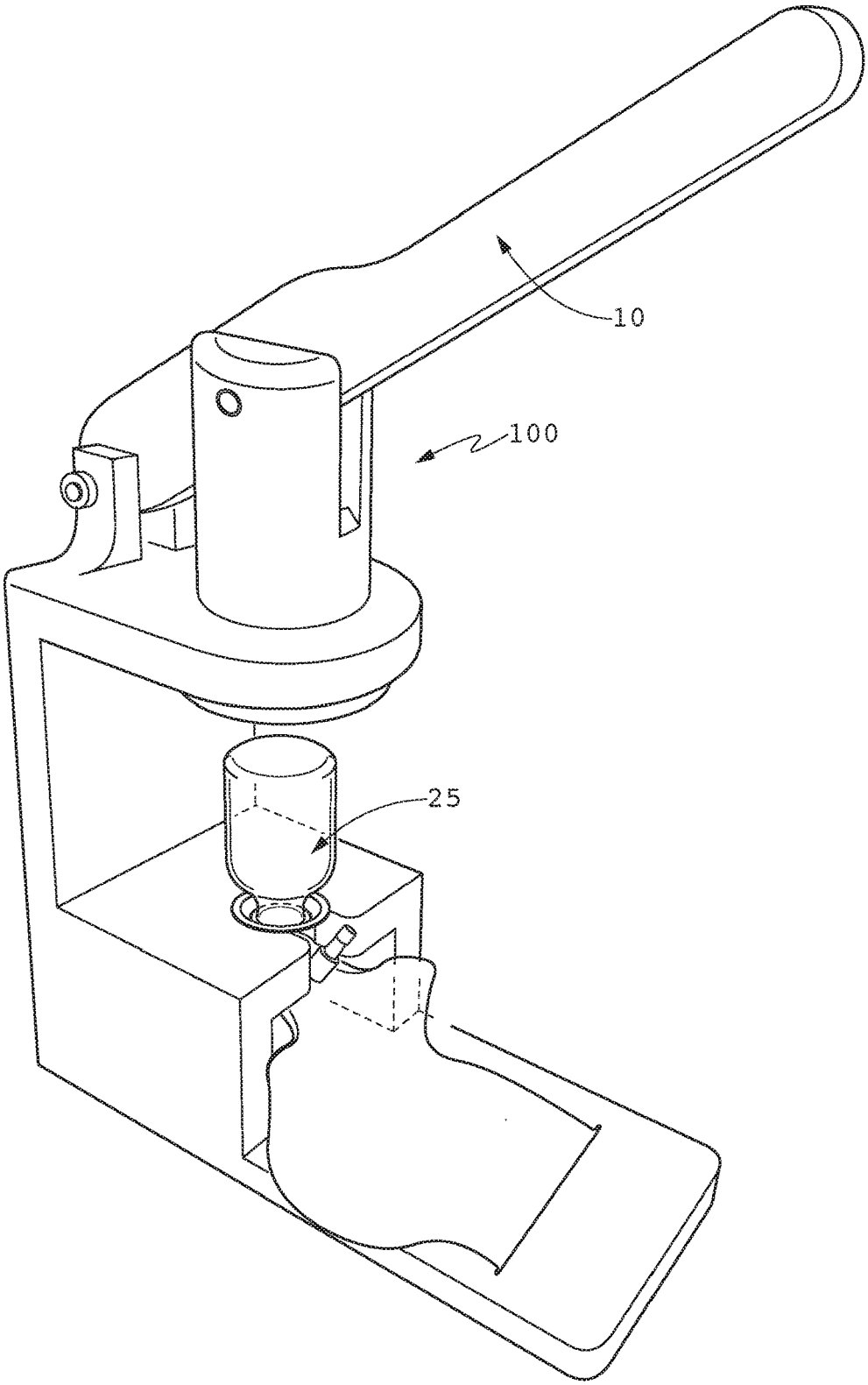
Figure 3F:
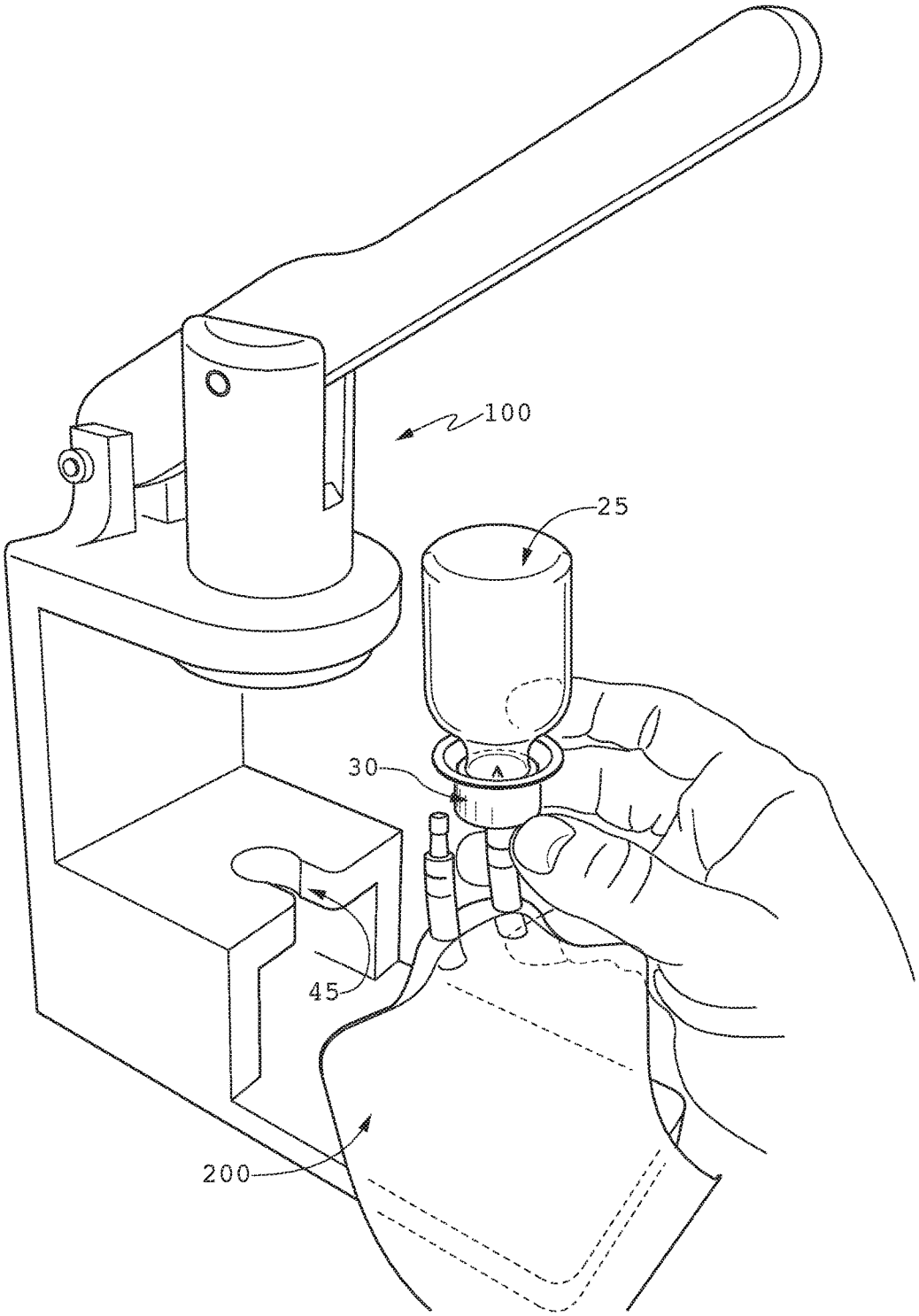

FIG. 3C is an illustration showing the vial 25 being placed within the device 100 for docking with the container 200. In this embodiment, the user may hold the vial 25 in place against the tapered portion 32, or generally an interior wall, of the cap 30. FIG. 3D is an illustration showing the downward motion of the lever arm 10 and plunger 15 once the vial 25 has been captured by the collar 20. At this point, the vial 25 is preferably being pressed into the cap 30 so that the vial 25 may be docked with the container 200. In this particular embodiment, the vial 25 is preferably pierced by the piercing aperture 36 of the cap 30 to establish fluid communication with the container 200. FIG. 3E is an illustration showing the upward motion of the lever arm 10 and plunger 15 following a successful docking procedure. FIG. 3F is an illustration showing a vial 25 that has been docked with a container 200 after removing it from the device 100. Here, the cap 30 and portions of the container 200 are permitted to exit the device 100 through the notch 45.

Figure 4A:
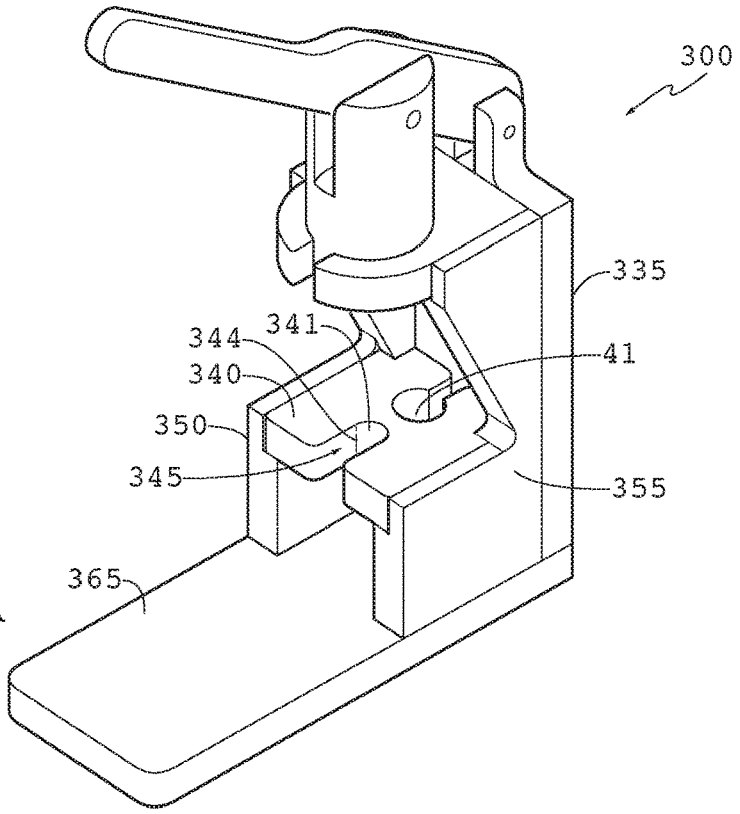
FIGS. 4A-4C are a series of perspective views of a second exemplary embodiment of the device illustrating a removable platform.
Figure 4B:
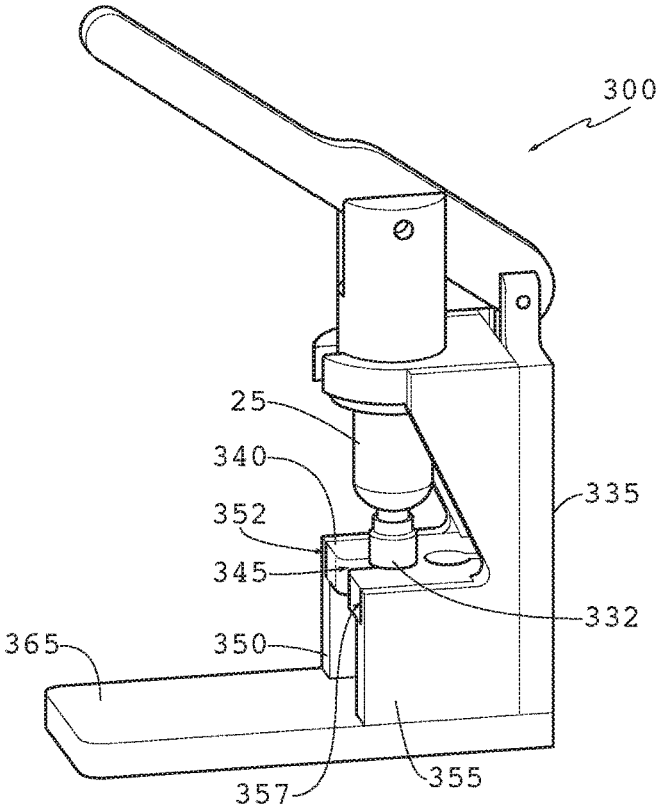
Figure 4C:
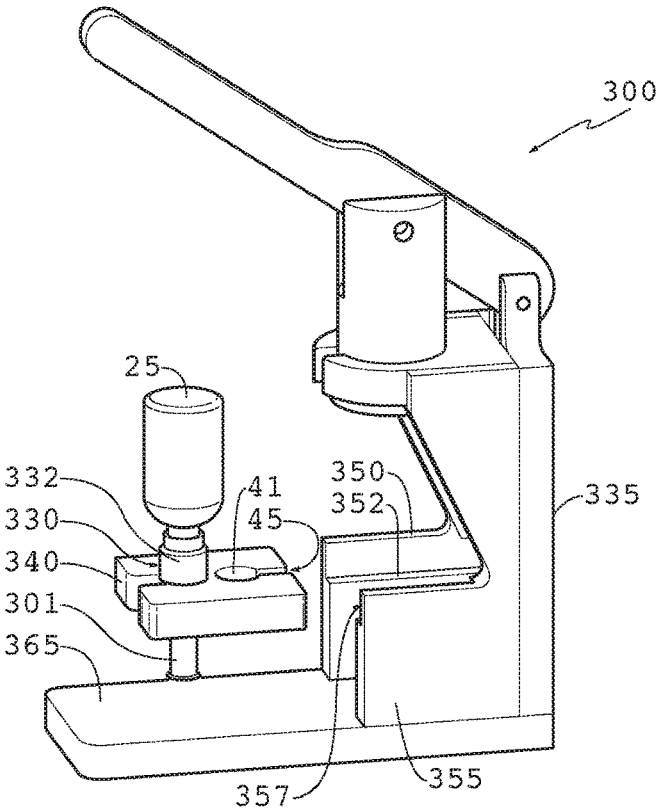

As shown in FIGS. 4A-4C, in a second exemplary embodiment of the device 300, the platform 340 is removable. An alternative first base member 350 and second base member 355 are configured to removably support the platform 340, thereby allowing its removal in order to insert a different platform or the same platform in a different configuration. Preferably, the first base member 350 has a channel 352 along its top interior edge. The second base member 355 also has a channel 357 along its top interior edge. When the first base member 350 and second base member 355 are arranged such that the first 352 and second channels 357 channels mirror each other, the platform 340 may be set inside the channels supporting the platform 340 from the bottom but allowing it to slide in and out of the length of the channels along horizontal axes. FIG. 4B presents a detailed view of the platform 340 supported by first 352 and second 357 channels in this manner. Note also that temporary additional securing means may be used to increase the retention forces of the platform 340 within the first 350 and second 355 members of the base 365. For example, the first 352 and second 357 channels may be aligned slightly skew from parallel to one another to provide a retaining force when the platform 340 has been fully inserted therein, or suction or adhesive materials may be included between the bottom surface of the platform 340 and the corresponding ledges of the first 352 and second 357 channels. Alternatively, when the platform 340 is slid all the way back towards the vertical support 335, as shown in FIG. 4C, the platform 340 may be secured temporarily to the vertical support 335 to prevent the platform 340 from sliding out unintentionally. The platform 340 may be secured to the vertical support 335 in a plurality of ways that will be apparent to skilled artisans. For example, the platform may be secured to the vertical support 335 through magnetic, suction, adhesive, or mechanical means.

FIGS. 4A-4C further illustrate an embodiment in which the platform 340 is configured such that it may be reversed in orientation to accommodate a particular type of adapter. The platform 340 in this embodiment includes, for instance, opposing first 45 and second 345 notches horizontally directed toward one another from opposing ends of the platform 340, each of the notches terminating at first 41 and second 341 apertures. In this embodiment, the first notch and aperture are as described in connection with FIGS. 1-3F, and the second notch and aperture are configured to accept a second common adapter type commonly referred to in the art as a vial-mate adapter, for instance. For equilateral-shaped platforms, those skilled in the art will appreciate that more than two sides may be configured with notch and aperture configurations, and that more than one such configuration may be provided per side regardless, thereby permitting the invented device to be easily used with a large number of vial, adapter and container types. Alternatively still, a single platform may be configured for each type of vial and adapter combination, if so desired, and changed as necessary during use.

Figure 11A:
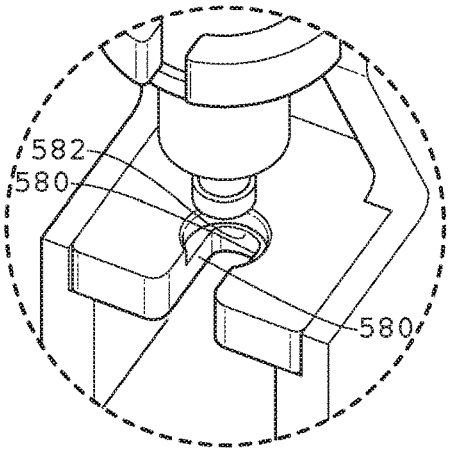
FIGS. 11A-11B are detailed perspective views of the platform element thereof.
Figure 11B:
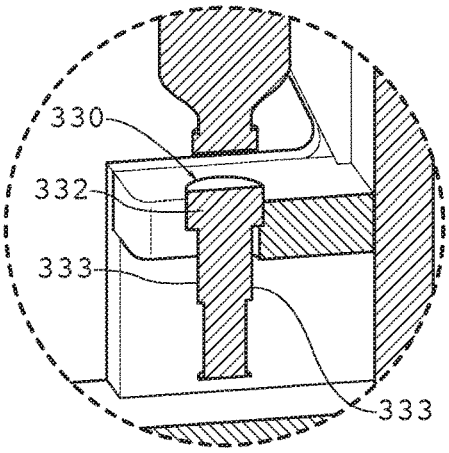

As shown in FIG. 4A, in an exemplary embodiment, the diameter of the second aperture 341 is approximately the same size as the width of the corresponding notch 345. The inner surface of the aperture 341 may also have one or more guide channels 344 arranged to accept a complimentary ridge on the outside wall of an adapter (see, e.g., FIG. 11B). The guide channels 344 may be arranged opposite of the notch 345 or at 90 degrees offset with respect to the center line of the notch 345 as depicted in the FIG. 4A. The first aperture 41 arranged at the opposite end of the platform 340 has a diameter larger than that of the notch 45, as previously explained. The first aperture 41 and notch 45 are configured to accept the cap 30 as shown in FIG. 1 but small enough not to allow the cap 30 to pass vertically through the aperture 41. The opening 345 in FIG. 4A, is configured to allow the tube 201 shown in FIG. 3A to pass through it but is smaller than the cap 30.

Further, FIGS. 4B and 4C show the exemplary embodiment of the device 300 wherein an adapter 330, is inserted into the second aperture 341 such that the base of a collar on the adapter 330 rests on top of the platform 340. In a preferred embodiment, the size of the aperture 341 is large enough to accept the adapter's cylindrical tube 301 portion but small enough to keep the adapter's collar from passing through the aperture 341.

Figure 5:
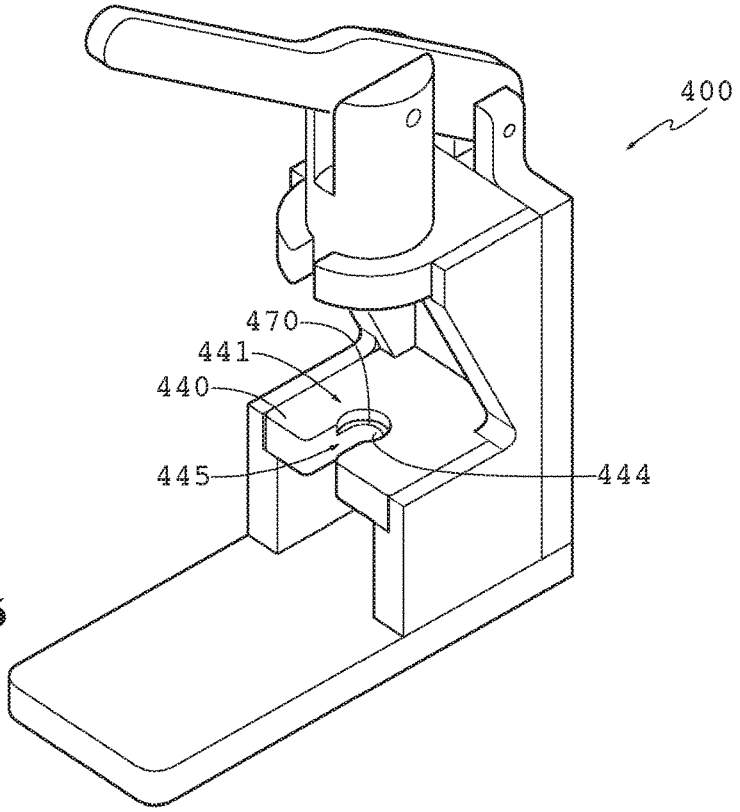
FIG. 5 is a perspective view of a third exemplary embodiment of the device.

FIG. 5 shows a third exemplary embodiment of the device 400 wherein the platform 440 comprises a single aperture 441. The single aperture 441 is configured to accept multiple kinds of adapters. For example, the aperture may accept an adapter such as a vial-mate-style adapter such as adapter 330 depicted in connection with FIG. 4C, or may accept a container cap 30 depicted in FIG. 3A. The aperture 441 comprises two or more concentric circular holes having different diameters and different depths respect to the top or bottom surface of the platform 440. For example, as shown in FIG. 5, the upper portion of the aperture 441 comprises a larger diameter circle than lower portion, and does not extend the entire thickness of the platform 440. The larger portion of the aperture 441 is configured such that its diameter is larger than the notch 445 extending thereto from a side of the platform 440. The notch 445 may be approximately the same size as the diameter of the smaller portion of the aperture 441. When the larger portion is arranged on the top surface of the platform 440 and does not extend through the entire platform as does the smaller portion, a ledge 470 is formed to accept an adapter that is small enough to pass through the larger portion, but not the small portion, of the aperture 441. In an exemplary embodiment, the smaller portion also comprises at least one channel 444 extending vertically along the interior surface of the lower portion of the aperture 441. The channel 444 may be arranged opposite the notch 445, as in this embodiment, or may be arranged in other configurations such as previously described herein in connection with other embodiments.

Figure 6:
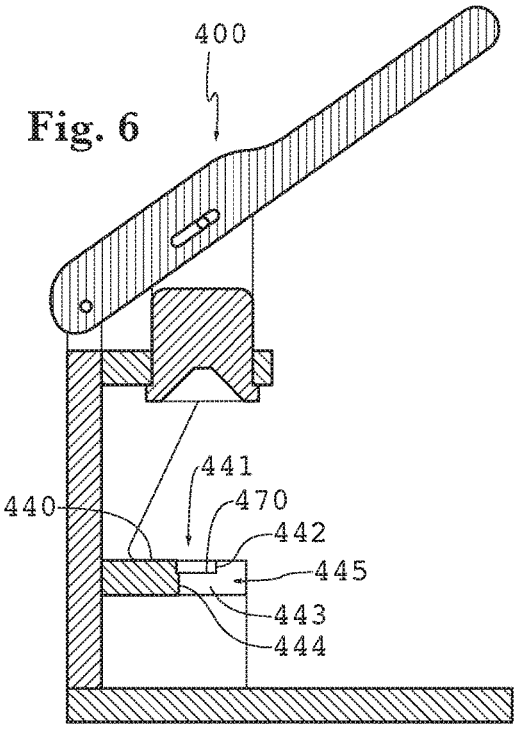
FIG. 6 is a side sectional view thereof.
Figure 7:
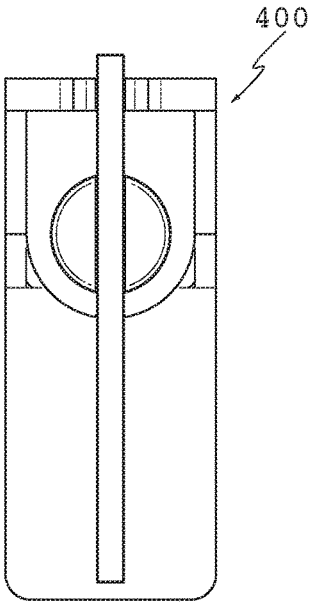
FIG. 7 is a top view thereof.

FIG. 6 is a side section view of the third exemplary embodiment of the present invention, taken through the center plane of symmetry of the device 400 as shown in FIG. 5. In this view, the centrally-aligned guide channel 444, ledge 470, and upper 442 and lower 443 portions of the aperture 441 are more clearly depicted. FIG. 7 shows a top view of this embodiment of the device 400 in which the vertically alignment of the components are better illustrated.

Figure 8:
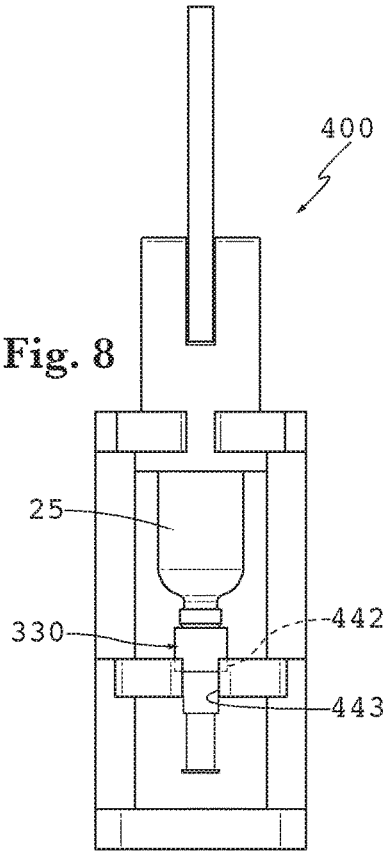
FIG. 8 is a front view thereof.
Figure 9:
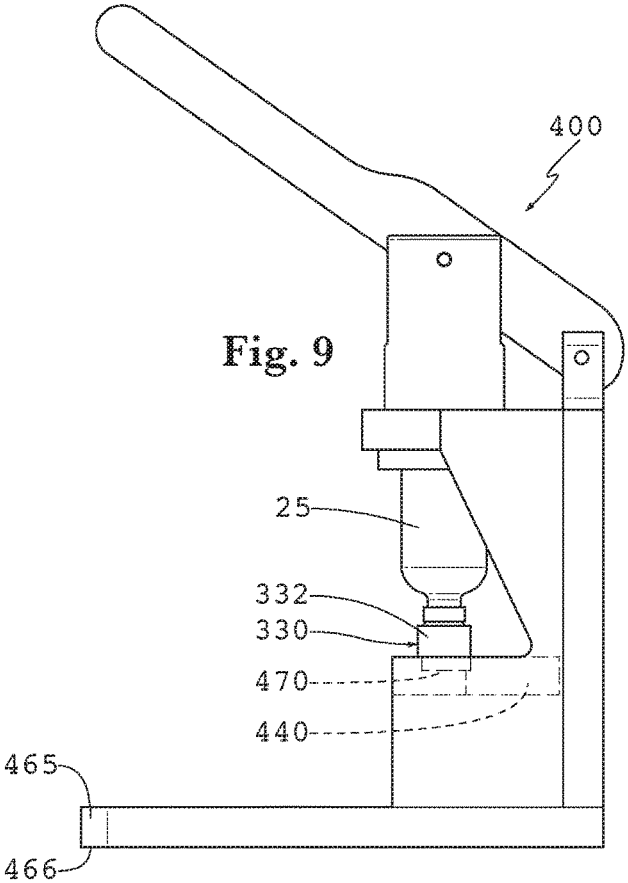
FIG. 9 is a side view thereof.

FIGS. 8 and 9 show a front and side view, respectively, of the third exemplary embodiment of the invented device 400. These figures illustrate how an adapter 330 extends below the platform 440 into the cavity 460 space below the platform 440. The seating of the collar 332 of such an adapter 330 on the ledge 470 between the upper 442 and lower 443 portions of the aperture 441 is also depicted therein. The figures also illustrate a vial 25 placed in the device 400 and arranged directly over the adapter 330. In an exemplary embodiment, the base 465 of the present invention may be secured to a working surface through magnetic, adhesive, suction, or mechanical means by attaching for example suction, adhesive, or magnetic materials to the bottom surface 466 of the base 465 which may contact or interact with a working surface (not shown) temporarily or permanently securing the base 465 to the working surface.

Figure 10:
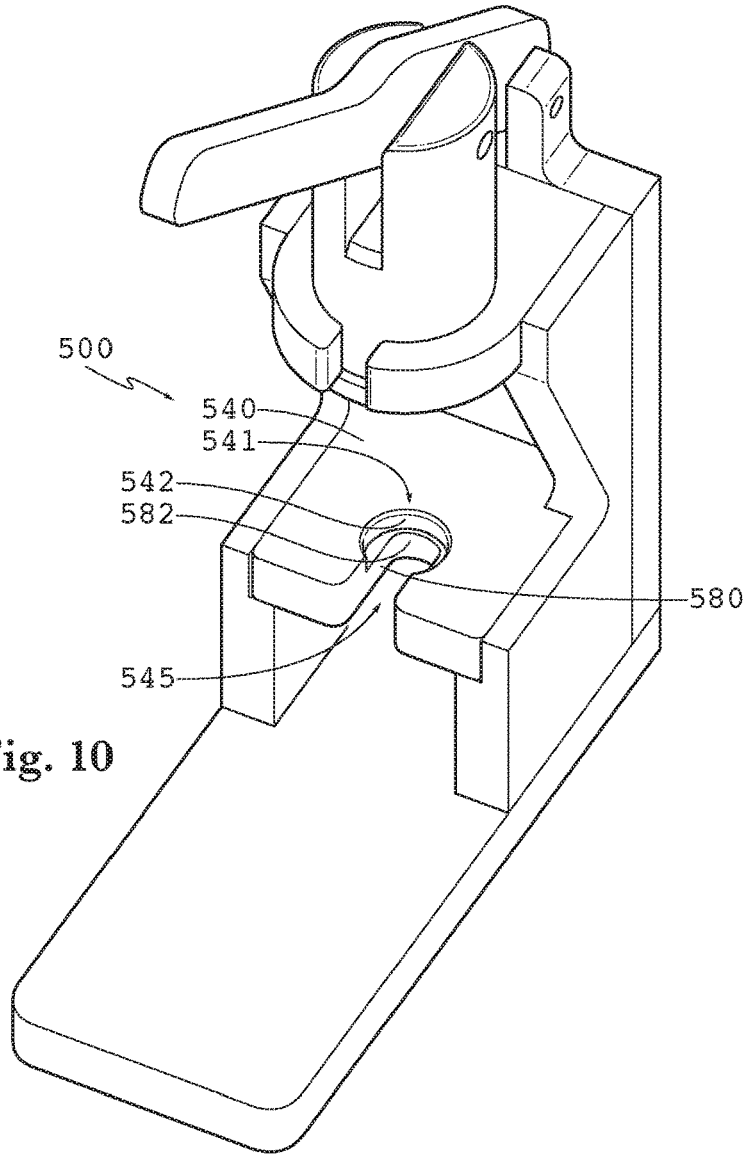
FIG. 10 is a perspective view of a fourth exemplary embodiment of the device.

Turning finally to FIG. 10, a fourth exemplary embodiment of the device 500 is shown. This embodiment differs from the embodiment shown in connection with FIG. 5, for example, as it does not have one or more guide channels configured to accept complimentary ridges on the adapter (e.g., 444 in FIG. 5). An illustrative view of such complimentary ridges is depicted in connection with FIG. 11B, which is a detailed partial view of the platform 540 of the device 500 and adapter 330 fitted therein. Here, the collar 332 of the adapter 330 fits within the upper, larger diameter portion 542 of the aperture 541. The lower portion, however, is not entirely circular, but instead is formed of two parallel sides 580 extending from an opening or notch 545 and joined by a curved back wall 582. The radius of curvature of the curved back wall 582 with respect to the center of the aperture 541 is sufficient such that a complimentary ridge 333 of the adapter 330 fits and is movable therein. However, the parallel sides 580 prevent the adapter from rotating an angle greater than that traversed by arc of the curved back wall 582. In this manner, and effective and simple alignment mechanism is achieved. The platform may be removable or permanently fixed to the device in this embodiment, as desired.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

What is claimed is:

1. A device for docking a vial with an adapter comprising:
a base comprising a first and second base member;
a vertical support extending upwardly from the base;
a platform positioned above the base;
a first aperture in the platform sized to accept the adapter;
a second aperture in the platform arranged opposite the first aperture;
a head support extending from the vertical support;
a lever arm hingedly fastened to the vertical support; and
a plunger adapted to slide within the head support and attached to the lever arm such that rotation of the lever arm causes the plunger to travel vertically;
wherein the first and second aperture each have an opening, wherein the openings are positioned along opposing edges of the platform;
wherein each of said first and second base members comprise an interior channel located along an interior edge of the respective base member to removably support said platform such that the opening associated with the first aperture or the opening associated with the second aperture may selectively be exposed.

2. The device of claim 1 wherein:
the bottom of the plunger has a conical recess; and
a centerline of the first aperture is aligned with a centerline of the conical recess.

3. The device of claim 1 further comprising:
a collar attached to the plunger which limits the upward vertical movement of the plunger.

4. The device of claim 1 wherein:
the first aperture comprises a guide channel extending from the top of the platform to the bottom.

5. The device of claim 1 wherein:
the first aperture comprises at least two concentric apertures having a common center-line, different diameters, and different depths.

6. The device of claim 1 wherein:
the first and second aperture have different diameters.

7. The device of claim 1 wherein:
the first aperture is comprised of an upper portion and a lower portion arranged to create a ledge located along an upper surface of the lower portion and adapted to receive the adapter seated thereon.

8. The device of claim 7 wherein:
the upper portion is sized larger in a horizontal dimension than the lower portion.

9. The device of claim 8 wherein:
the lower portion comprises a pair of parallel sides joined by a curved back wall.

10. A device for docking a vial with an adapter comprising:
a base;
a vertical support extending upwardly from the base;
a removable platform positioned above the base and substantially parallel to the base;
a first aperture in the platform sized to accept the adapter but not allowing the adapter to pass completely through;
a second aperture in the platform arranged opposite the first aperture;
a first notch extending from the first aperture to a first edge of the platform;
a second notch extending from the second aperture to a second edge of the platform, wherein the second side is located opposite the first side;
a head support extending horizontally from the vertical support;
a lever arm hingedly fastened to the vertical support; and
a plunger adapted to slide within the head support and attached to the lever arm such that rotation of the lever arm causes the plunger to travel vertically to press the vial down to dock with the adapter secured within the first aperture;
wherein the first aperture comprises a channel extending from the top of the platform to the bottom;
wherein the first aperture is comprised of an upper portion and a lower portion arranged to create a ledge located within the channel and adapted to receive the adapter seated thereon;
wherein the first and second aperture have different diameters.

11. The device of claim 10 wherein:
the first aperture comprises at least two concentric apertures having a common center-line but different diameters.

12. The device of claim 10 wherein:
the upper portion is sized larger in a horizontal dimension than the lower portion.

13. The device of claim 12 wherein:
the lower portion comprises a pair of parallel sides joined by a curved back wall.

* * * * *